US009455512B2

(12) United States Patent
Chen

(10) Patent No.: US 9,455,512 B2
(45) Date of Patent: Sep. 27, 2016

(54) ELECTRICAL CONNECTOR WITH LOCKING STRUCTURES

(71) Applicant: OUPIIN ELECTRONIC (KUNSHAN) CO., LTD, Kunshan (CN)

(72) Inventor: Hsin Chih Chen, Kunshan (CN)

(73) Assignee: OUPIIN ELECTRONIC (KUNSHAN) CO., LTD. (CN)

( * ) Notice: Subject to any disclaimer, the term of this patent is extended or adjusted under 35 U.S.C. 154(b) by 0 days.

(21) Appl. No.: 14/854,811

(22) Filed: Sep. 15, 2015

(65) Prior Publication Data

US 2016/0093977 A1 Mar. 31, 2016

(30) Foreign Application Priority Data

Sep. 28, 2014 (CN) ..... 2014 2 0562792

(51) Int. Cl.
*H01R 13/60* (2006.01)
*H01R 12/72* (2011.01)
*H01R 12/70* (2011.01)

(52) U.S. Cl.
CPC ..... *H01R 12/724* (2013.01); *H01R 12/7029* (2013.01)

(58) Field of Classification Search
CPC ..... H01R 12/7035; H01R 23/7021; H01R 13/6595
USPC ..... 439/567, 847, 79
See application file for complete search history.

(56) References Cited

U.S. PATENT DOCUMENTS 5,468,154 A * 11/1995 Yip ..... H01R 12/724 439/381
6,095,853 A * 8/2000 Huang ..... H01R 12/727 439/541.5
6,939,173 B1 * 9/2005 Elco ..... H01B 11/12 439/607.34

* cited by examiner

*Primary Examiner* — Phuong Dinh
(74) *Attorney, Agent, or Firm* — Roger D. Emerson; Emerson Thomas Bennett

(57) ABSTRACT

An electrical connector with locking structures is disclosed. The electrical connector comprises an insulation housing, two locking plates, multiple power terminals and multiple signal terminals. The insulation housing forms two locking structures, each of which includes a platform, a vertical fastener passage, a horizontal holding passage and a vertical block. There forms a gap between the vertical block and a bottom support wall of the holding passage. Each locking plate is an L type and has a horizontal locking portion, a vertical locking portion and a locking foot. The horizontal locking portion is fixed in the holding passage, the vertical locking portion is clamped in the gap, and the locking foot is used to fix the electrical connector on a circuit board. The locking structure can ensure the locking plate to be fixed on a preset position, thereby protecting the electrical connector when using.

10 Claims, 7 Drawing Sheets

ELECTRICAL CONNECTOR WITH LOCKING STRUCTURES

BACKGROUND OF THE INVENTION

1. Field of the Invention

The present invention relates to a connector technology, and more particularly to an electrical connector with locking structures.

2. Description of the Prior Art

Generally, one electrical connector is fixed on a circuit board by using a SMT (Surface Mounted Technique) way and depends on a welding force between tails of terminals of the electrical connector and pads of the circuit board. The other electrical connector is fixed on the circuit board by using a through-hole fixing way and depends on an interference force between tails of terminals of the electrical connector and welding holes of the circuit board. But the welding force and the interference force can not ensure the mounting safety of the electrical connector. Specifically, when the electrical connector is mated with a complementary connector, the insertion force will damage the connection between the tails of the terminals and the pads or the welding holes of the circuit board. Therefore, this will effect the electrical transportation and connection.

In the prior art, the electrical connector needs to dispose a locking structure for protecting the electrical connection between the terminals and the circuit board.

However, it is still necessary to research a new locking structure and a new locking plate with the highest safety. The locking structure can prevent the locking plate from jumping upward and ensure the locking plate to be fixed on a preset position.

BRIEF SUMMARY OF THE INVENTION

An object of the present invention is to provide an electrical connector with locking structures, which can prevent a locking plate from jumping upward or moving backward during the mounting or mating process, thereby ensuring that the locking plate can be fixed on a preset position after being mounted.

The other object and the advantage of the present invention may be further understood from the technical features disclosed by the present invention.

To achieve the above object of the present invention, the present invention adopts the following technical solution.

The present invention provides an electrical connector with locking structures. The electrical connector comprises an insulation housing, two locking plates, multiple power terminals and multiple signal terminals. The insulation housing includes a mating portion located on the front thereof and a mounting portion located on the rear thereof. A front surface of the mating portion is perpendicular to a bottom surface of the mounting portion. The mating portion forms a receiving cavity extending backward from the front surface, and the mounting portion forms multiple power terminal-receiving passages and multiple signal terminal-receiving passages. The mounting portion further forms two locking structures, which are symmetrically disposed on two sides thereof and each of which includes a platform, a vertical fastener passage, a horizontal holding passage and a vertical block. The holding passage is formed under the platform and is parallel to the platform. The vertical block is located under the platform, and there forms a gap between the vertical block and a bottom support wall of the holding passage along the front and back direction. The power terminals and the signal terminals are respectively fixed in the power terminal-receiving passages and the signal terminal-receiving passages. Each locking plate is an L type and has a horizontal locking portion, a vertical locking portion and a locking foot extending downward from the vertical locking portion. The horizontal locking portion is inserted and fixed in the holding passage, the vertical locking portion is clamped in the gap, and the locking foot is used to fix the electrical connector on a circuit board.

In one embodiment, the locking structure further includes a holding slot, which is formed between the vertical block and the platform; and the locking plate further has a locking arm protruding outward from the side of the vertical locking portion and extending into the holding slot.

In one embodiment, the vertical block extends upward from the bottom surface of the mounting portion, the height of the vertical block is not beyond the holding passage, and the vertical block and the bottom support wall of the holding passage are staggered to form a step shape.

In one embodiment, the gap is formed between a front surface of the vertical block and a rear surface of the bottom support wall of the holding passage along the front and back direction.

In one embodiment, the size of the gap is equal to the thickness of the locking plate.

In one embodiment, the platform is lower than a top surface of the mounting portion and near the bottom surface of the mounting portion.

In one embodiment, the fastener passage vertically extends downward from the platform to the bottom surface of the mounting portion, a side of the fastener passage is open, the fastener passage has a vertical surface facing a front surface of the vertical block, and the vertical surface of the fastener passage and the front surface of the vertical block are parallel to each other.

In one embodiment, each power terminal has a power mating end being exposed in the receiving cavity of the insulation housing, a power fixing portion being received and fixed in the corresponding power terminal-receiving passage, and a power mounting end extending out of the bottom surface of the mounting portion; and each signal terminal has a signal mating end being exposed in the receiving cavity of the insulation housing, a signal fixing portion being received and fixed in the corresponding signal terminal-receiving passage, and a signal mounting end extending out of the bottom surface of the mounting portion.

In one embodiment, the insulation housing further includes a guiding pin, which is disposed in the receiving cavity and horizontally extends forward from a rear wall of the receiving cavity; the guiding pin is located between two or two groups of adjacent power terminals for spacing the two or two groups of adjacent power terminals.

In one embodiment, the mating portion further forms two semicircular guiding holes, which are symmetrically disposed on two sides of the receiving cavity.

In comparison with the prior art, the electrical connector with locking structures of the present invention disposes the two locking structures being symmetrically disposed on two sides thereof The horizontal holding passage of each locking structure can prevent the locking plate from jumping upward during the mounting process, and the vertical block can prevent the locking plate from moving backward during the mounting process during the mounting or mating process, so that the locking plate can be fixed on a preset position after being mounted and can provide the function of fixing the electrical connector when being mated with the complementary connector.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "top", "bottom", "front", "back", "left", "right", "top", "bottom" etc., are only used with reference to the orientation of the accompanying drawings. Therefore, the used directional terms are intended to illustrate, but not to limit, the present invention.

Figure 1:
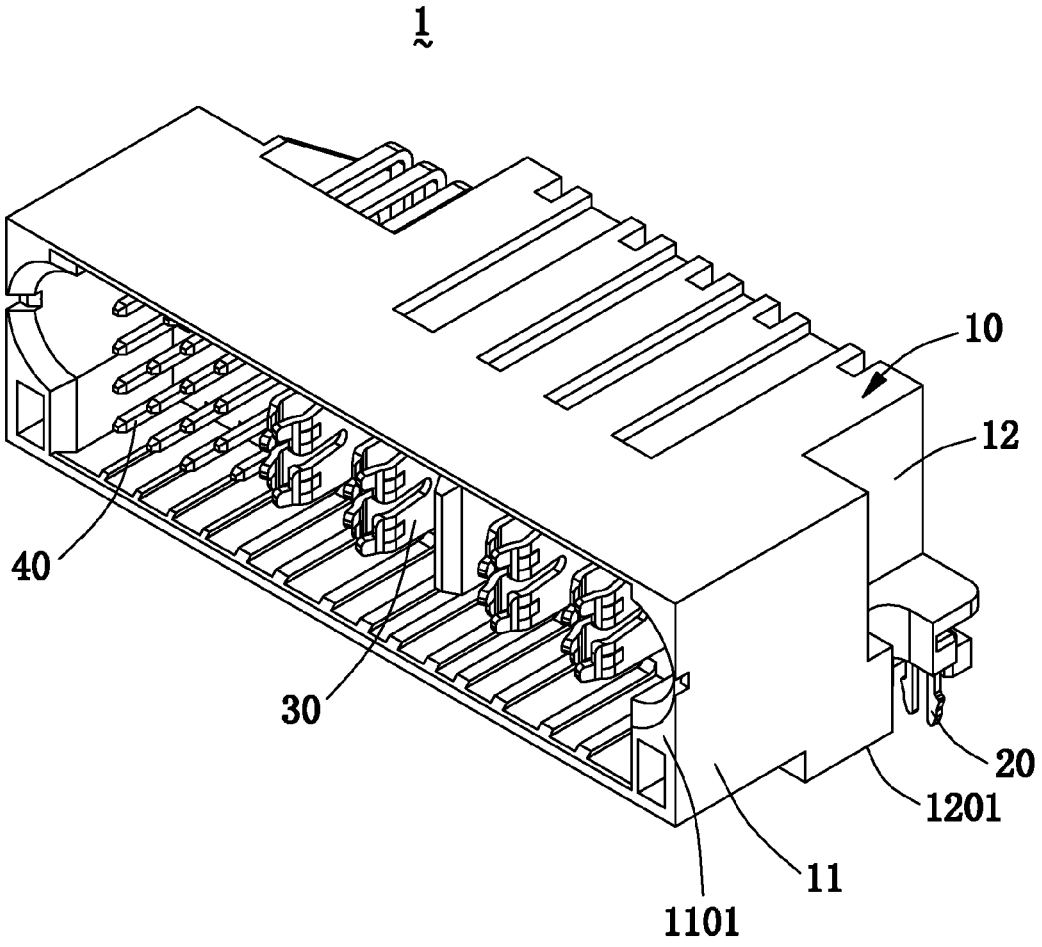
FIG. 1 is a perspective schematic view of an electrical connector with locking structures of the present invention.
Figure 2:
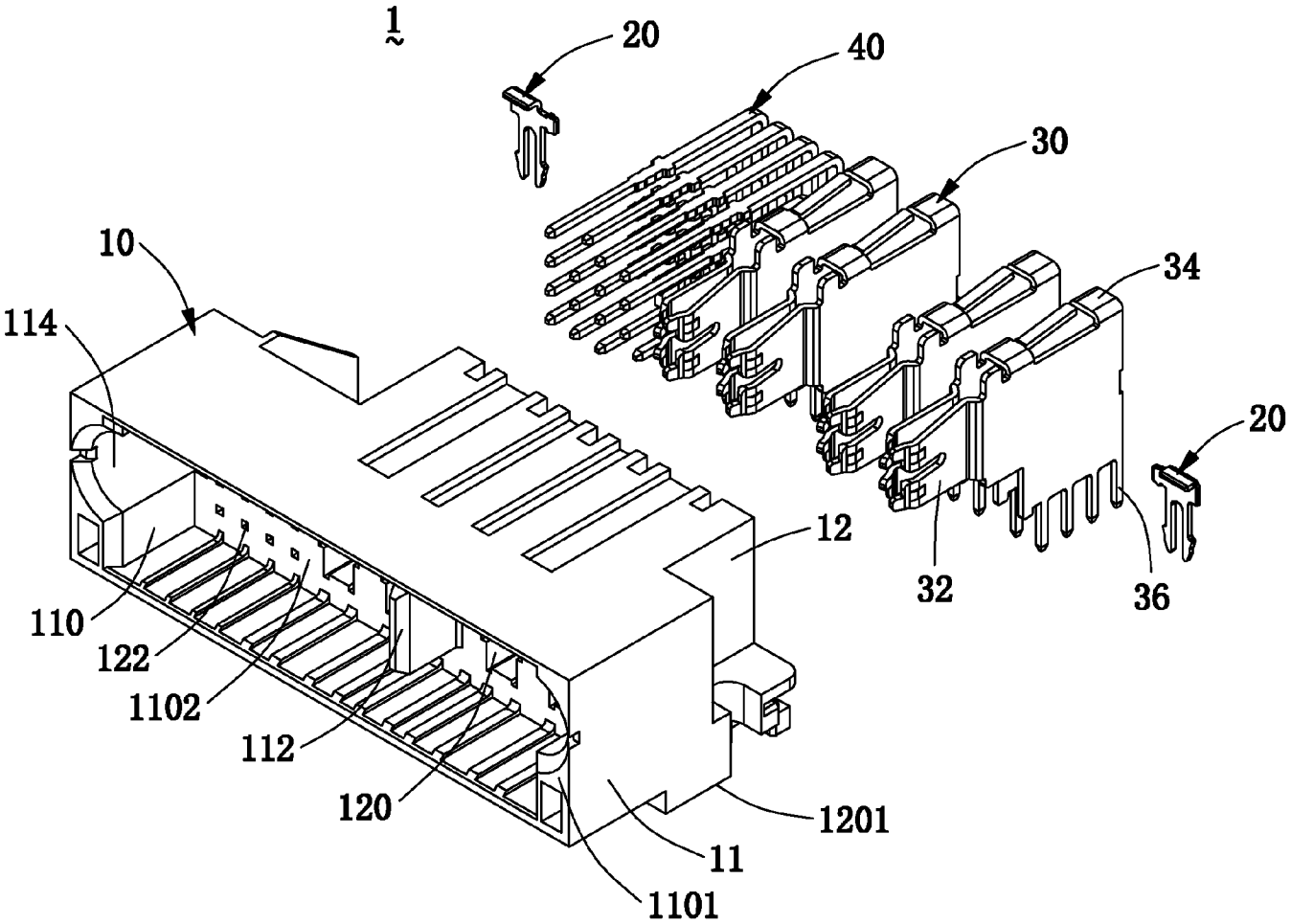
FIG. 2 is an exploded view of the electrical connector of FIG. 1.
Figure 3:
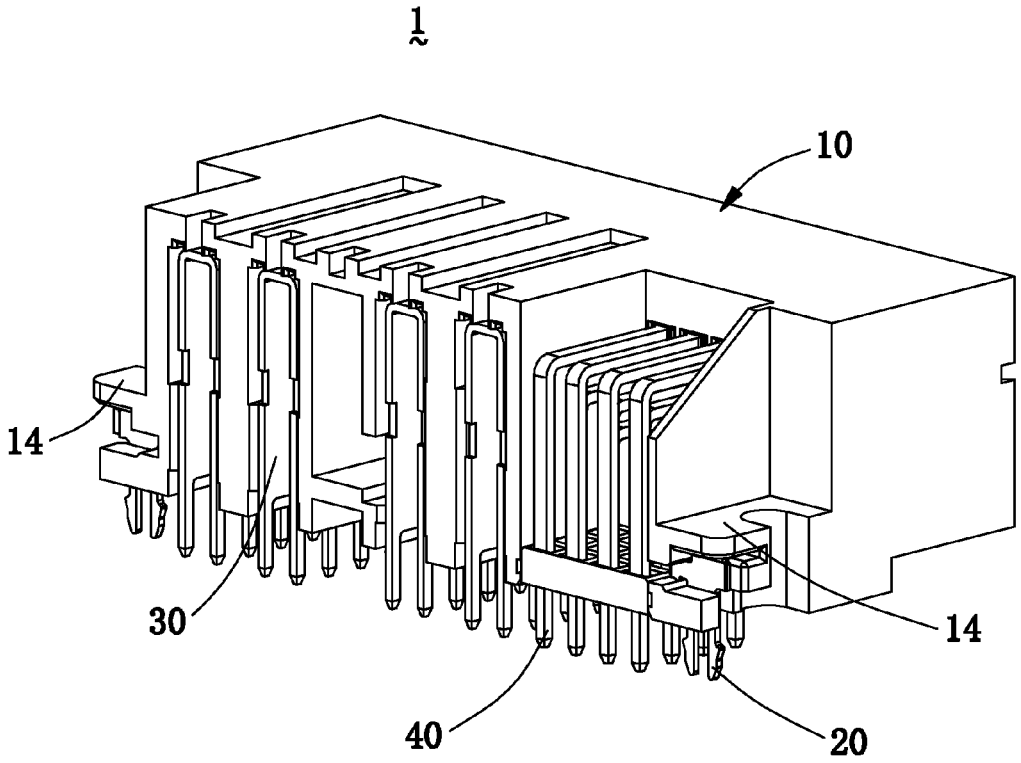
FIG. 3 is a perspective schematic view of the electrical connector along another direction.
Figure 4:
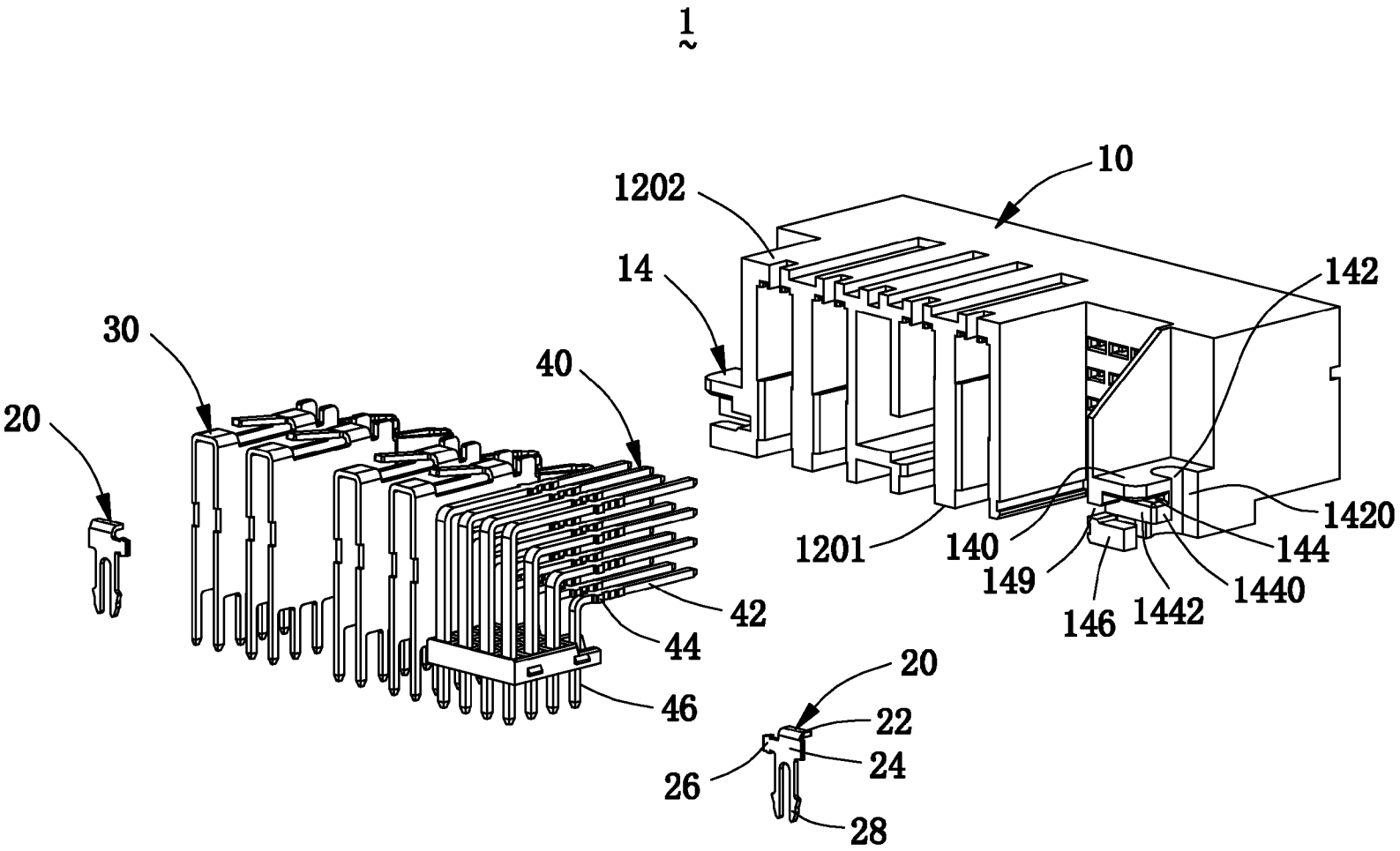
FIG. 4 is an exploded view of the electrical connector of FIG. 3.
Figure 5:
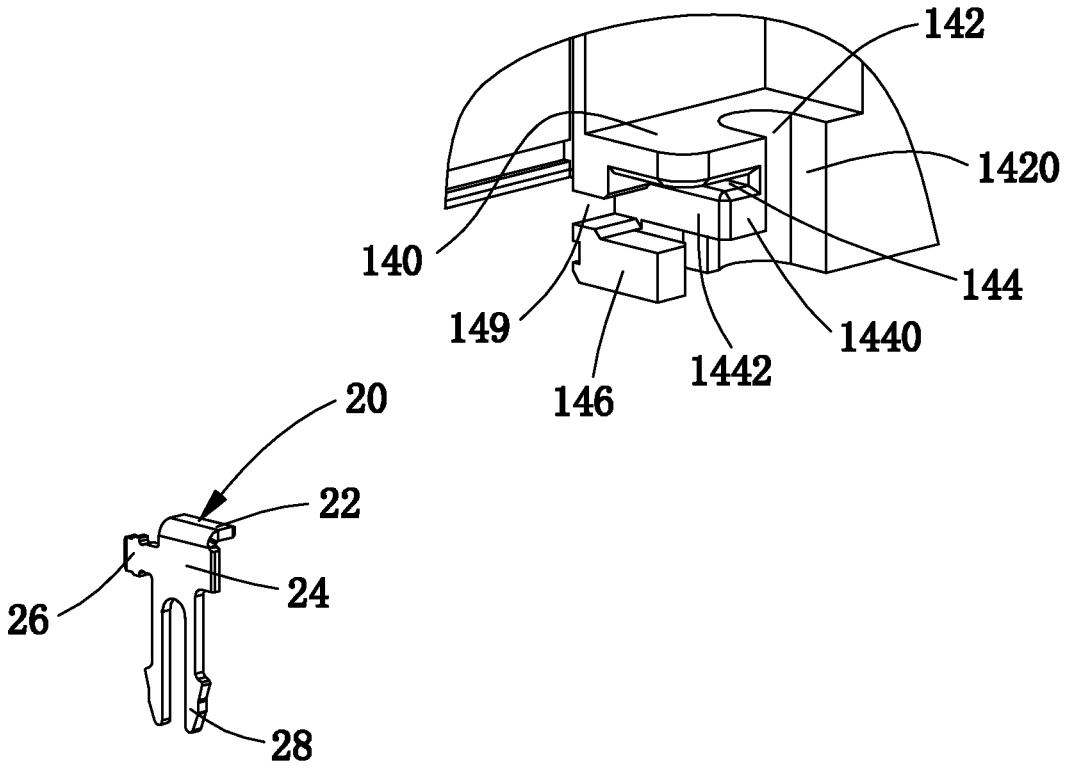
FIG. 5 is an enlarged view of a locking structure and a locking plate of the electrical connector.
Figure 6:
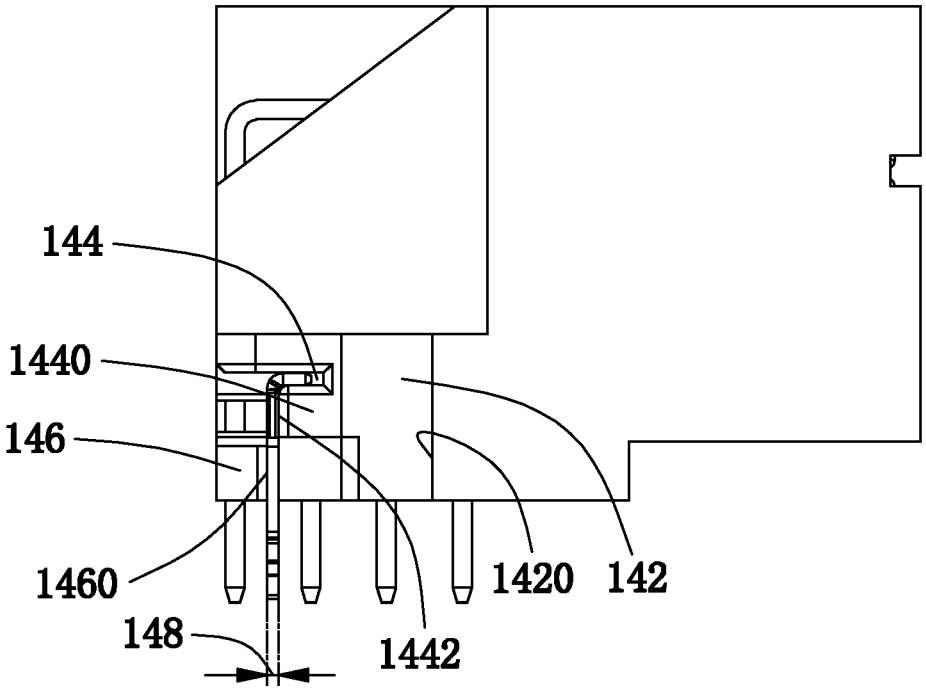
FIG. 6 is a left side schematic view of the electrical connector of FIG. 1.
Figure 7:
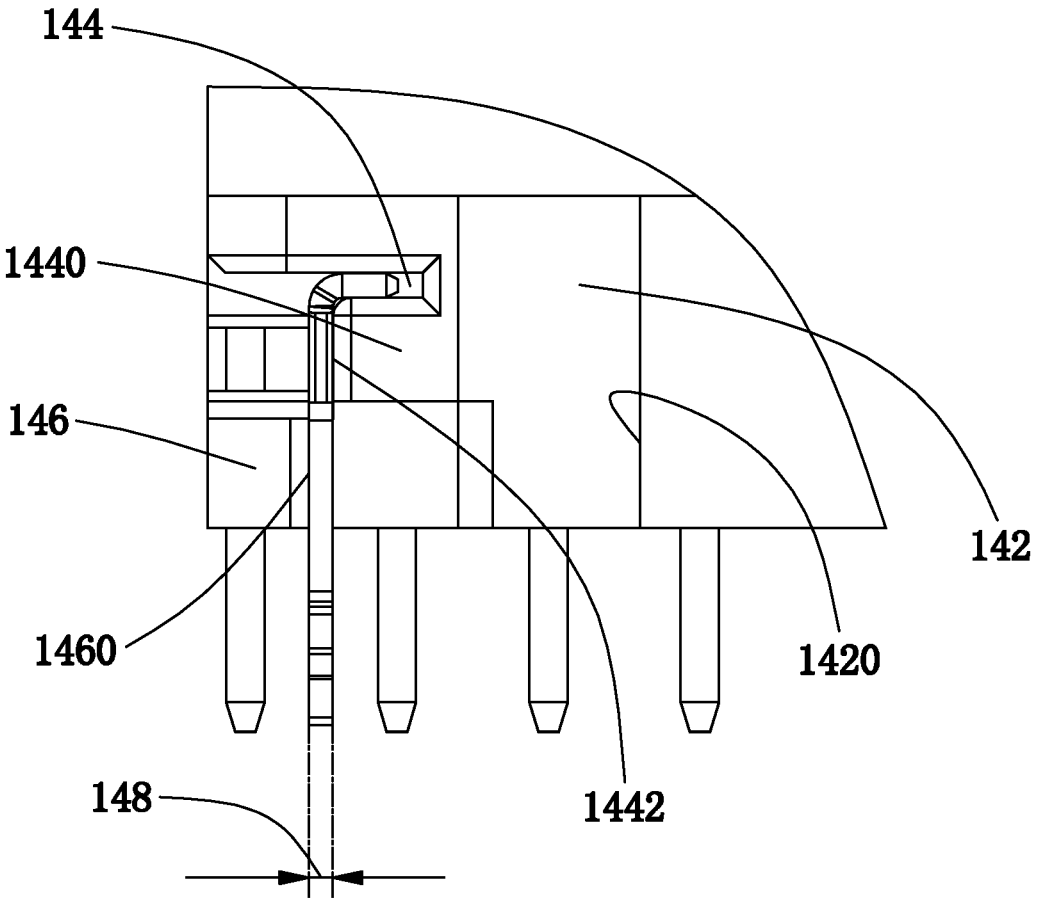
FIG. 7 is a partial enlarged plane view of FIG. 6.

Please refer to FIGS. 1 to 7, FIG. 1 is a perspective schematic view of an electrical connector 1 with locking structures of the present invention; FIG. 2 is an exploded view of the electrical connector 1 of FIG. 1; FIG. 3 is a perspective schematic view of the electrical connector 1 along another direction; FIG. 4 is an exploded view of the electrical connector 1 of FIG. 3; FIG. 5 is an enlarged view of a locking structure 14 and a locking plate 20 of the electrical connector 1; FIG. 6 is a left side schematic view of the electrical connector 1 of FIG. 1; and FIG. 7 is a partial enlarged plane view of FIG. 6.

Please refer to FIGS. 1 to 4, the electrical connector 1 of the present invention is a horizontal plug connector, the mating direction of which is parallel to a circuit board (not shown) and which can transport signal and power. The electrical connector 1 comprises an insulation housing 10, two locking plates 20, multiple signal terminals 30 and multiple power terminals 40.

As shown in FIGS. 1 and 2, the insulation housing 10 includes a mating portion 11 located on the front of the insulation housing 10 and a mounting portion 12 located on the rear of the insulation housing 10. A front surface 1101 of the mating portion 11 is perpendicular to a bottom surface 1201 of the mounting portion 12. When the electrical connector 1 is mounted on the circuit board, the bottom surface 1201 of the mounting portion 12 is located on the circuit board, and the front surface 1101 of the mating portion 11 protrudes beyond a front edge of the circuit board for being mated with a complementary connector (not shown).

As shown in FIG. 2, the mating portion 11 forms a receiving cavity 110 extending backward from the front surface 1101 thereof. The mounting portion 12 forms multiple power terminal-receiving passages 120 and multiple signal terminal-receiving passages 122 to respectively receive and fix the power terminals 30 and the signal terminals 40. The insulation housing 10 further includes a guiding pin 112, which is disposed in the receiving cavity 110 and horizontally extends forward from a rear wall 1102 of the receiving cavity 110. The guiding pin 112 is located between two or two groups of adjacent power terminals 30 for spacing the two or two groups of adjacent power terminals 30. Moreover, the mating portion 11 further forms two semicircular guiding holes 114, which are symmetrically disposed on two sides of the receiving cavity 110.

As shown in FIGS. 3 and 4, the mounting portion 12 forms two locking structures 14 symmetrically disposed on two sides thereof Please refer to FIGS. 4 and 5, each locking structure 14 includes a platform 140, a vertical fastener passage 142, a horizontal holding passage 144 and a vertical block 146. The platform 140 is lower than a top surface 1202 of the mounting portion 12 and near the bottom surface 1201 of the mounting portion 12.

Please refer to FIGS. 4 and 5, the fastener passage 142 is vertical and vertically extends downward from the platform 140 to the bottom surface 1201 of the mounting portion 12. A side of the fastener passage 142 is an open structure. That is, the side of the fastener passage 142 forms an opening. When the electrical connector 1 needs to be mounted on the circuit board, an outer fastener (not shown) is inserted into the fastener passage 142 and then enters into a fixing hole of the circuit board for fixing the electrical connector 1 onto the circuit board. The fastener passage 142 has a vertical surface 1420 facing the vertical block 146.

Please refer to FIG. 5, the holding passage 144 is formed under the platform 140 and parallel to the platform 140. The holding passage 144 is perpendicular to the fastener passage 142. The outer side of the holding passage 144 is also open, so the locking plate 20 can be mounted into the holding passage 144.

Please refer to FIG. 5, the vertical block 146 is also located under the platform 140. A front surface 1460 (numeral shown in FIGS. 6 and 7) of the vertical block 146 faces the vertical surface 1420 of the fastener passage 142, and the front surface 1460 and the vertical surface 1420 are parallel to each other, as shown in FIGS. 6 and 7. There forms a space between the front surface 1460 and the vertical surface 1420. Moreover, there forms a gap 148 (shown in FIGS. 6 and 7) between the vertical block 146 and a rear surface 1442 of a bottom support wall 1440 of the holding passage 144 along the front and back direction. Specifically, the vertical block 146 extends upward from the bottom surface 1201 of the mounting portion 12, and the height of the vertical block 146 is not beyond the holding passage 144. The vertical block 146 and the bottom support wall 1440 are staggered to form a step shape. Therefore, the gap 148 is formed between the front surface 1460 of the vertical block 146 and the rear surface 1442 of the bottom support wall 1440 along the front and back direction. The size of the gap 148 is generally equal to the thickness of the locking plate 20, so the locking plate 20 is capable of being mounted in the locking structure 14.

Please refer to FIGS. 4 and 5, there forms a holding slot 149 between the vertical block 146 and the platform 140.

Please refer to FIG. 3, the locking plate 20 of the electrical connector 1 is fixed into the locking structure 14. The detail structure of the locking plate 20 can refer to FIGS. 4 and 5. As shown in FIGS. 4 and 5, the locking plate 20 is generally an L type, which has a horizontal locking portion 22, a vertical locking portion 24, a locking arm 26 protruding outward from the side of the vertical locking portion 24, and a locking foot 28 extending downward from the vertical locking portion 24.

Please refer to FIG. 5, the horizontal locking portion 22 of the locking plate 20 can be inserted and clamped in the holding passage 144. The vertical locking portion 24 can enter into and be clamped in the gap 148. The locking arm 26 can extend into and be fixed in the holding slot 149. When the electrical connector 1 need be mounted in the circuit board, the locking foot 28 can be inserted and fixed in a through hole of the circuit board for fixing the electrical connector 1 on the circuit board.

Please refer to FIG. 2, each power terminal 30 is a right-angled type, which has a power mating end 32, a power fixing portion 34 and a power mounting end 36. The power fixing portion 34 is received and fixed in the corresponding power terminal-receiving passage 120, the power mating end 32 is exposed in the receiving cavity 110 of the insulation housing 10, and the power mounting end 36 extends out of the bottom surface 1201 of the mounting portion 12 for being connected with the circuit board.

Please refer to FIG. 4, each signal terminal 40 is also a right-angled type, which has a signal mating end 42, a signal fixing portion 44 and a signal mounting end 46. The signal fixing portion 44 is received and fixed in the corresponding signal terminal-receiving passage 122, the signal mating end 42 is exposed in the receiving cavity 110 of the insulation housing 10, and the signal mounting end 46 extends out of the bottom surface 1201 of the mounting portion 12 for being connected with the circuit board.

As described above, the electrical connector 1 of the present invention disposes the two locking structures 14 being symmetrically disposed on two sides thereof. The horizontal holding passage 144 of each locking structure 14 can prevent the locking plate 20 from jumping upward during the mounting process, and the vertical block 146 can prevent the locking plate 20 from moving backward during the mounting process during the mounting or mating process, so that the locking plate 20 can be fixed on a preset position after being mounted and can provide the function of fixing the electrical connector 1 when being mated with the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector with locking structures, comprising:

an insulation housing including a mating portion located on the front thereof and a mounting portion located on the rear thereof, a front surface of the mating portion being perpendicular to a bottom surface of the mounting portion, the mating portion forming a receiving cavity extending backward from the front surface, and the mounting portion forming multiple power terminal-receiving passages and multiple signal terminal-receiving passages, wherein the mounting portion further forms two locking structures, which are symmetrically disposed on two sides thereof and each of which includes a platform, a vertical fastener passage, a horizontal holding passage and a vertical block; the holding passage being formed under the platform and being parallel to the platform, the vertical block being located under the platform, and there forming a gap between the vertical block and a bottom support wall of the holding passage along the front and back direction;

multiple power terminals and multiple signal terminals, which are respectively fixed in the power terminal-receiving passages and the signal terminal-receiving passages; and two locking plates, each of which is an L type and has a horizontal locking portion, a vertical locking portion and a locking foot extending downward from the vertical locking portion; the horizontal locking portion being inserted and fixed in the holding passage, the vertical locking portion being clamped in the gap, and the locking foot being used to fix the electrical connector on a circuit board.

2. The electrical connector with locking structures as claimed in claim 1, wherein the locking structure further includes a holding slot, which is formed between the vertical block and the platform; and the locking plate further has a locking arm protruding outward from the side of the vertical locking portion and extending into the holding slot.

3. The electrical connector with locking structures as claimed in claim 2, wherein the vertical block extends upward from the bottom surface of the mounting portion, the height of the vertical block is not beyond the holding passage, and the vertical block and the bottom support wall of the holding passage are staggered to form a step shape.

4. The electrical connector with locking structures as claimed in claim 3, wherein the gap is formed between a front surface of the vertical block and a rear surface of the bottom support wall of the holding passage along the front and back direction.

5. The electrical connector with locking structures as claimed in claim 4, wherein the size of the gap is equal to the thickness of the locking plate.

6. The electrical connector with locking structures as claimed in claim 1, wherein the platform is lower than a top surface of the mounting portion and near the bottom surface of the mounting portion.

7. The electrical connector with locking structures as claimed in claim 1, wherein the fastener passage vertically extends downward from the platform to the bottom surface of the mounting portion, a side of the fastener passage is open, the fastener passage has a vertical surface facing a front surface of the vertical block, and the vertical surface of the fastener passage and the front surface of the vertical block are parallel to each other.

8. The electrical connector with locking structures as claimed in claim 1, wherein each power terminal has a power mating end being exposed in the receiving cavity of the insulation housing, a power fixing portion being received and fixed in the corresponding power terminal-receiving passage, and a power mounting end extending out of the bottom surface of the mounting portion; and each signal terminal has a signal mating end being exposed in the receiving cavity of the insulation housing, a signal fixing portion being received and fixed in the corresponding signal terminal-receiving passage, and a signal mounting end extending out of the bottom surface of the mounting portion.

9. The electrical connector with locking structures as claimed in claim 1, wherein the insulation housing further includes a guiding pin, which is disposed in the receiving cavity and horizontally extends forward from a rear wall of the receiving cavity; the guiding pin is located between two or two groups of adjacent power terminals for spacing the two or two groups of adjacent power terminals.

10. The electrical connector with locking structures as claimed in claim 1, wherein the mating portion further forms two semicircular guiding holes, which are symmetrically disposed on two sides of the receiving cavity.

* * * * *